US005379611A

United States Patent [19]

Impagliazzo

[11] Patent Number: 5,379,611

[45] Date of Patent: Jan. 10, 1995

[54] JEWELRY CONVERTER APPARATUS

[76] Inventor: Michael R. Impagliazzo, P.O. Box 2682, Providence, R.I. 02907-0682

[21] Appl. No.: 77,277

[22] Filed: Jun. 17, 1993

[51] Int. Cl.[6] ..... A44C 7/00

[52] U.S. Cl. ..... 63/14.1; 63/1.1; 63/2; 63/14.4

[58] Field of Search ..... 63/1.1, 2, 12, 14.1, 63/21, 14.4; 24/90.5, 113 R, 113 MP, 90 A

[56] References Cited

U.S. PATENT DOCUMENTS

| | | | |
|---|---|---|---|
| 527,358 | 10/1894 | Bonner | 24/90.5 |
| 1,981,521 | 11/1934 | Mazer | 63/1 |
| 2,085,548 | 6/1937 | Sheer | 63/1 |
| 2,098,820 | 11/1937 | Belloch | 63/1.1 |
| 2,198,558 | 4/1940 | Handman | 63/1.1 |
| 2,214,839 | 9/1940 | Migliori | 63/1.1 |
| 2,285,051 | 6/1942 | Pujol | 63/1 |
| 2,751,654 | 6/1956 | Ambruster | 24/113 |
| 2,764,797 | 10/1956 | Carson | 24/90.5 |
| 3,122,007 | 2/1964 | Horland | 63/12 |
| 3,412,578 | 11/1968 | Rosencrans | 63/14 |
| 3,543,354 | 12/1970 | Huchman, Sr. et al. | 24/41 |
| 3,777,336 | 12/1973 | Anderson | 24/113 MP |
| 4,187,838 | 2/1980 | Dubrowski | 63/14.1 |
| 4,840,045 | 6/1989 | Moody | 63/12 |
| 5,020,338 | 6/1991 | Payne et al. | 63/12 |
| 5,048,311 | 9/1991 | Mastrobuono | 63/12 |

*Primary Examiner*—Michael J. Milano
*Attorney, Agent, or Firm*—Barlow & Barlow, Ltd.

[57] ABSTRACT

A converter mechanism is shown for converting a decorative button cover to another piece of jewelry. The converter has spaced plate members receivable on opposite sides of a U-shaped plate pivotally mounted on the button cover which is adapted, when in the open position, to slide beneath a button on either side of thread attaching the button to a garment. The button cover is then pivoted to a closed position locking the converter thereto. Selected attachment means, such as an ear ring clip, is integrally attached to the plate members to enable the piece of jewelry to be worn in a conventional manner.

4 Claims, 1 Drawing Sheet

JEWELRY CONVERTER APPARATUS

Figure 1:
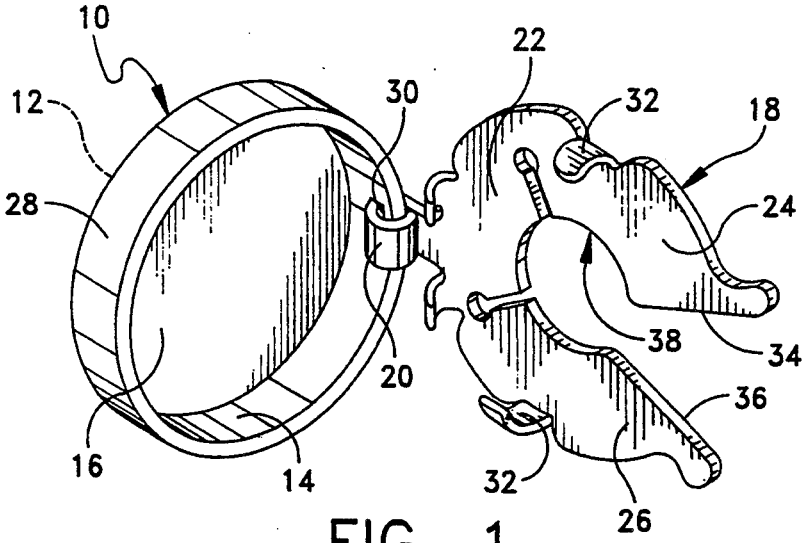
FIG. 1 (PRIOR ART)

This invention relates generally to jewelry and more particularly, to apparatus for converting one type of jewelry, such as a button cover, to another type of jewelry, such as an earring.

Decorative covers for buttons and the like are well known. One type of conventional cover, as disclosed in U.S. Pat. No. 3,777,336 issued to Anderson, comprises a disk having a decorative surface on its obverse side and a button receiving cavity with an attachment mechanism on its reverse side. For example, a generally U-shaped plate is pivotably mounted between an open position in which the spaced legs of the plate can be inserted beneath a button on either side of the thread attaching the button to a garment, and a closed, locked position against the reverse side of the disk capturing the button in the button receiving cavity between the U-shaped plate and the disk.

Convertible jewelry articles are also known in the art. For example, U.S. Pat. No. 5,048,311 issued to Mastrobuono discloses a convertible jewelry article for use as an earring which can receive interchangeable ornamental members. The jewelry article includes a clamp member 32 for engaging with the user's ear and a leg with semi-spherical member 60 for engaging with dome portion 24 of spring mounted plate 22 on ornamental member 10. Clamp 22 may only be used with an ornamental member with a plate having the specific structure of the dome 24 to receive spherical member 60. The ornamental member 10 and clamp 32 are designed specifically for each other. Jewelry article of the '311 patent suffers from incompatibility with the more common button covers as described above in U.S. Pat. No. 3,777,336.

It is an object of the present invention to provide a mechanism which can be used with a conventional button cover described above in order to convert it into another type of jewelry.

Another object is the provision of such a mechanism which is easily manufactured and which can be used with button covers for converting the covers to earrings, pins or ornaments for use on bracelets, necklaces or the like.

Briefly, a mechanism used to convert a button cover to another type of jewelry comprises first and second generally parallel extending plates spaced apart a distance selected to receive a U-shaped plate of a button cover therebetween. The lower plate is configured to fit within the button receiving cavity and a channel like member used to space the plates apart, is configured to fit closely between the legs of the U-shaped plate providing a selected orientation of the first and second plates relative to the cover. A jewelry attachment means, such as a pivotable earring clip, is connected to the first and second plates so that the cover can be attached to an ear in the normal manner of a clip-on earring. Other attachment means can be connected to the parallel plates such as a flat piece adapted to be received in the bore of a suitable fastener for attaching the device as an ornament on a chain or the like.

Figure 2:
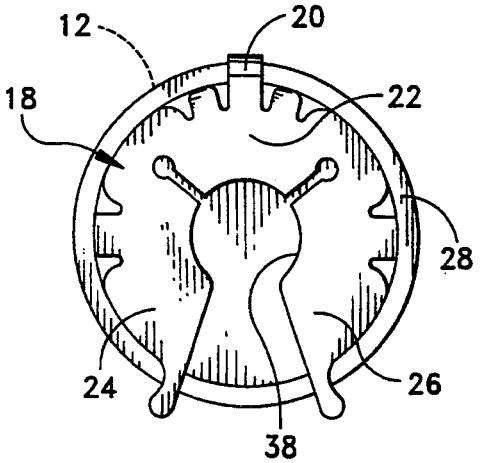
FIG. 2 (PRIOR ART)
Figure 3:
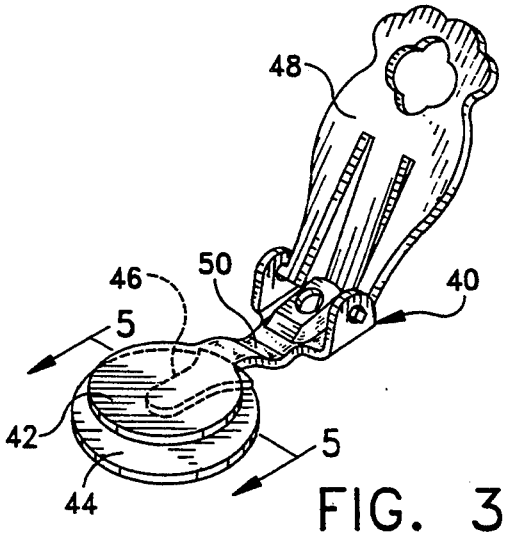
Figure 4:
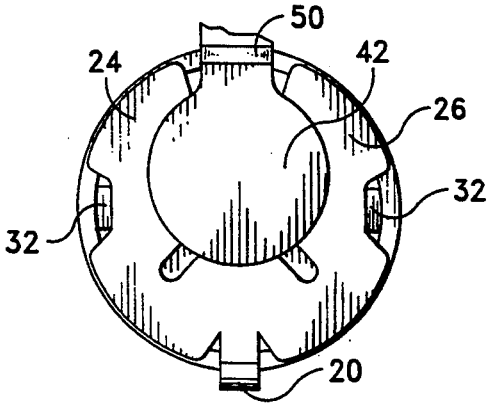
Figure 5:
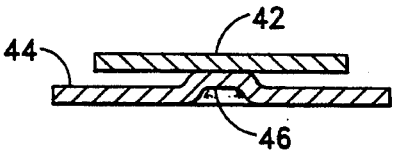

Other objects and features of the present invention will become apparent when referred to the accompanying drawings wherein FIG. 1 is a perspective view of a conventional button cover seen from the back with its pivotable U-shaped plate in its open position;

FIG. 2 is a front view of the button cover of FIG. 1 showing the U-shaped plate in its locked closed position;

Fig. is a perspective view of a converter mechanism made in accordance with the invention;

FIG. 4 is a bottom plan view of a button cover with the converter received on the U-shaped plate, the converter shown with its attachment means broken away for purposes of illustration; and FIG. 5 is a sectional view taken on line 5—5 of FIG. 3.

Referring to the drawings, numeral 10 designates a conventional button cover shown in FIGS. 1 and 2. Cover 10, which can be any selected shape as long as it is large enough to cover a button of a selected size, has an ornamental design on its obverse side 12 and a button receiving cavity 14 on its reverse side 16. A generally U-shaped plate 18 having a hinge 20 integrally attached at the bight 22 formed between first and second legs 24, 26. Cavity 14 is defined by a generally cylindrical wall 28 extending from cover 10 with hinge 20 received in an aperture 30 formed in wall 28. U-shaped plate 18 is provided with locking means in the form of tangs 32 extending from respective legs 24, 26 adapted to apply a bias against the inner wall surface of wall 28 when plate 18 is pivoted into its closed position shown in FIG. 2. The outer distal portion of wall 18 is rolled inwardly slightly (not shown) so that the tangs 32 will snap beyond the rolled portion providing a locked, closed position.

Legs 24, 26 are flared at 34, 36 respectively to facilitate placement of plate 18 beneath a button on either side of thread attaching the button to a garment. The plate is pushed beneath the button until the threads are received in central aperture 38 of plate 18 and then the cover is pivoted from the FIG. 1 position to the locked, closed position shown in FIG. 2.

In accordance with the invention, a converter 40 for use with button cover 10 comprises first and second generally parallel extending plates 42, 44 spaced apart from one another a distance selected to closely receive plate 18 therebetween. As seen in FIG. 5, plate 44 is formed with a channel 46 forming a spacing boss configured to fit closely between the flared legs 24, 26 of plate 18 so that the converter assumes a selected orientation relative to cover 10. It will be understood that channel 46 could, if desired, be formed in plate 42 or a separate element could be disposed between the plates. In any event, the plates lying in planes generally parallel to one another are attached to one another in any suitable manner, as by brazing. As seen in FIG. 3, a conventional earring clip 48 is integrally attached to converter 40 by means of a connector strip 50; however, other conventional attachment means, such as a flat blade member, could be employed to make the device useful as an ornament on a chain, for example.

It should be understood that although a preferred embodiment of the converter mechanism has been described by way of illustrating the invention, modifications of the converter are possible within the scope of the invention and the invention includes all modifications and equivalents of the disclosed embodiment falling within the scope of the appended claims.

I claim:

1. A decorative jewelry member comprising a disc having obverse and reverse sides, a generally U-shaped plate having a selected thickness and having a bight between first and second legs, the legs defining an opening therebetween a converter having first and second plate elements lying in planes generally parallel to one another, means to connect the plates together and to space the first and second plate elements a distance apart slightly greater than the selected thickness, attachment means for attaching the converter to an object, the converter being adapted to receive the U-shaped plate between the first and second plate elements and means to lock the converter to the U-shaped plate.

2. A decorative jewelry member according to claim 1 including a hinge connected to the bight of the U-shaped plate and to the reverse side of the jewelry member.

3. A decorative jewelry member according to claim 1 in which the means to space the first and second plate elements is configured to closely fit between the first and second legs of the U-shaped plate to provide a selected orientation of the converter relative to the disc.

4. A decorative jewelry member according to claim 1 in which the attachment means comprises an earring clip.

* * * * *